US005304739A

United States Patent [19]

Klug et al.

[11] Patent Number: 5,304,739

[45] Date of Patent: Apr. 19, 1994

[54] HIGH ENERGY COAXIAL CABLE FOR USE IN PULSED HIGH ENERGY SYSTEMS

[76] Inventors: Reja B. Klug, 30 Bay Dr. SE., Fort Walton Beach, Fla. 32548; Richard D. Ford, 117 Lake Lorraine Cir., Shalimar, Fla. 32579; Keith A. Jamison, 137 Indian Bayou Dr., Destin, Fla. 32541; Ronald E. Stearns, 2 Caswell Cir., Mary Esther, Fla. 32569

[21] Appl. No.: 810,252

[22] Filed: Dec. 19, 1991

[51] Int. Cl.[5] ..... H01B 9/02

[52] U.S. Cl. ..... 174/102 R; 174/106 R; 174/107; 174/110 FC

[58] Field of Search ..... 174/102 R, 106 R, 105 R, 174/107, 110 FC, 36

[56] References Cited

U.S. PATENT DOCUMENTS

| | | | |
|---|---|---|---|
| 3,429,984 | 2/1969 | Alexander | 174/115 |
| 4,332,976 | 6/1982 | Hawkins | 174/107 |
| 4,340,773 | 7/1982 | Perreault | 174/107 |
| 4,346,253 | 8/1982 | Saito et al. | 174/29 |
| 4,472,216 | 9/1984 | Hogenhout et al. | 174/106 R |
| 4,532,375 | 7/1985 | Weitzel et al. | 174/107 |
| 4,584,431 | 4/1986 | Tipple et al. | 174/107 |
| 4,614,926 | 9/1986 | Reed et al. | 333/244 |
| 4,626,810 | 12/1986 | Nixon | 333/243 |
| 4,847,448 | 7/1989 | Sato | 174/103 |
| 4,960,965 | 10/1990 | Redmon et al. | 174/102 R |
| 4,987,274 | 1/1991 | Miller et al. | 174/102 R |
| 5,086,196 | 2/1992 | Brookbank et al. | 174/106 R |

OTHER PUBLICATIONS

IEEE Transaction on Magnetics, vol. 27, No. 1, Jan. 1991 High Energy Cable Development for Pulsed Power Applications.

*Primary Examiner*—Morris H. Nimmo

[57] ABSTRACT

Commercially available coaxial cables have been used successfully in single shot electromagnetic launcher and other pulsed power applications. The use of a coaxial cable interface between power source and pulsed power load reduces external magnetic fields and also aids in standardizing the interface, enhancing inter-changeability between a variety of power supplies and loads. As pulsed power systems continue to become more energetic and as the importance of repetitive operation increases, the use of commercially available cables becomes impractical because of the large number required for appropriate energy transfer. The cable according to the invention overcomes many problems encountered in the use of conventional cables. It incorporates a large area, flexible conductor in both the current feed and current return path, and matches these conductor cross-sections to provide uniform current paths. It also incorporates high temperature PFA TEFLON insulation capable of operating at 260 degrees C, and uses a high strength woven fiber cover to resist intense forces produced by internal currents and magnetic fields. A standardized, uniform dimension, nonarcing interface termination is also provided. The combination of components and materials easily allows this cable to be used to replace more than six conventional cables.

3 Claims, 1 Drawing Sheet

HIGH ENERGY COAXIAL CABLE FOR USE IN PULSED HIGH ENERGY SYSTEMS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to a high energy coaxial cable for use in pulsed high energy systems.

Coaxial cables have long been used in the communication field and to a limited extent in pulsed power applications. Traditionally, these cables are designed for continuous transmission of relatively low power electrical signals having very broad range of frequency content. Because of the desire to transmit such signals with high fidelity, cables are carefully designed for specific uniform cross-section dimension over their length. The resulting impedance eliminates electrical mismatch when load and source impedances match the designed inter-connecting cable impedance. In such applications, transmitted electrical signals generally utilize only a thin surface layer of the conductor because of their broad spectrum and high frequency content. As a result, conductor cross-section is not a primary concern, and matched cross-section areas between inner and outer conductors are not usually considered in the design. Additionally, the insulating material used between conductors is usually selected based on its dielectric rather than thermal properties. Polyethylene, foamed polymers, and air are most frequently used.

Typically, temperature of the conductor, temperature capability of the insulator, and strength of the assembly in resisting radial stress produced by electromagnetic forces acting to repel the current carrying conductors, are of little significance in such designs.

In electromagnetic launcher and other pulsed power research, power pulses up to several tens of milliseconds duration and peak current of hundreds to thousands of kiloamperes must be transmitted between the power source and electrical load. Traditionally, power transmission is accomplished using large cross-section, high strength, rigid metal conductors. Such inter-connects require clamping mechanisms to restrain electromagnetic forces, often must resist recoil forces from high mass acceleration, and usually require inter-connections specifically designed for each installation. These inter-connections often produce intense electromagnetic fields which interfere with electronic devices and induce strong currents into other conductors, such as diagnostic cables located in the near vicinity of the current transmission path. These systems also introduce secondary problems such as high inter-connection inductance and potentially hazardous exposed electrical components.

In some system designs, commercially available coaxial cables have been used successfully to transmit power pulses described above. These designs require large numbers of cables to overcome deficiencies such as small, non-uniform conductor cross-sections and relatively low melting temperature of insulating materials. At megampere current levels and in repetitively fired systems where heating buildup is additive, the large number of conventional cables needed for an installation makes such designs impractical.

The following United States patents relate to various designs for coaxial cable.

4,987,274—Miller et al.
4,960,965—Redmon et al.
4,847,448—Sato
4,626,810—Nixon
4,614,926—Reed et al.
4,584,431—Tippie et al.
4,346,253—Saito et al.
4,340,773—Perreault
4,332,976—Hawkins In particular, the Miller et al. patent describes a coaxial cable with insulation comprised of 60–25% fluorpolymer that is fibrillatable, 40–75% ceramic filler, and a void volume. The preferred fluropolymer matrix disclosed is PTFE, and the preferred ceramic filler is fused amorphous silica powder. The Redmon et al. patent relates to a coaxial cable with a conventional metallic center conductor and conventional polyethylene as the dielectric material. The outer conductor is formed over the dielectric layer which acts as a mandrel. The outer conductor comprises emplaced, small diameter carbon fibers which are stabilized in place by an impregnating resin. The Sato patent describes a coaxial cable having a metal deposited tape wound over the laterally wound shielding layer, which is, in turn, formed over an insulation layer about the conductor. The tape is disposed such that the metal layer is in contact with the laterally wound shielding layer. The Nixon patent relates to a low attenuation high frequency coaxial cable in which the center conductor is wrapped with a plurality of layers of low density PTFE dielectric material. In addition, at least one layer of high density, unsintered PTFE dielectric material is tightly wrapped around the low density tape. The high density material is then sintered to form an envelope to hold the low density material in position. The outer conductor comprises longitudinally extending, parallel, adjacent electrically conductive wire strands, which are applied with a slight helical lay around the dielectric of the cable. The Reed et al. patent describes a high power coaxial cable comprising an inner conductor and an outer conductor with insulated fittings disposed between the inner and outer conductors. The fittings are disposed near opposite ends of the cable to maintain a desired spacing between the inner and outer conductors. One of the insulated fittings has a plurality of longitudinal holes therethrough. The fitting is formed in two like sections joined at right angles to one another along a substantially 45 degree interface, thereby defining a short 90 degree turn for the inner conductor near the end of the cable. The fitting sections are retained in position by a surrounding mounting block. The Tippie et al. patent relates to a high voltage coaxial cable in which a room temperature curable silicone elastomeric material is applied under pressure to the outer surface of the cable braid. The material is forced between the voids of the braid and adheres to the primary insulation material at the insulation/braid interface. The Saito et al patent describes a coaxial cable comprising inner and outer conductors each provided as a corrugated tube. The conductors are arranged coaxially with a thermoplastic resin insulating member therebetween. The insulating member is composed of a spiral rib joined to an outer insulating tube. The special rib is made of high density polythylene and the insulating tube of low density polythylene. The Perreault patent relates to a dielectric system for coaxial electrical conductors. The system separates an inner and outer conductor, and is composed of a first layer of cellular polyparabanic acid. This layer directly contacts and provides a continuous skin circumferentially surrounding the inner conductor along its length. A second layer, consisting of crosslinkable polymeric laquer, provides a continuous skin enclosing the first layer. The Hawkins patent describes a dielectric system for coaxial electrical conductors. The system separates an inner and outer conductor, and is composed of a first layer of braided high tensile strength polymeric fluorocarbon filaments. The filaments form an open weave and surround the inner conductor. Surrounding the filaments is a layer of cellular polyparabanic acid tape, which is helically wound along the length of the cable. A polymeric film circumferentially surrounds the two layers, and is in turn surrounded by a continuous layer of a crosslinkable polymeric lacquer.

SUMMARY OF THE INVENTION

An objective of the invention is to provide a strong, flexible, quickly changeable electrical circuit connection, for use in inter-connecting pulsed electrical power devices operating at peak current of hundreds to thousands of kiloameperes. A further objective is to reduce the number of inter-connecting cables required for a desired system operating current, while maintaining easy operator installation and removal. Typical loads which will benefit by use of this cable include electromagnetic launchers, nuclear weapons simulators, fusion reactor experiments, etc.

The invention overcomes the problems described above by utilizing large cross-section flexible conductors, high temperature insulators, and a high strength containment structure. The conductor is selected to accommodate very high current while remaining sufficiently small to permit ease in handling. Flexibility is provided by using bundles of fine wire, with bundles counter-wound in layers. This counter-winding technique also reduces external magnetic fields. Maximum current capability is provided for the cable by matching center conductor cross-section to that of the coaxial outer conductor. At the high peak current possible for these cables, conventional insulators would melt and be destroyed. Thus, by incorporating a TEFLON or other high temperature insulator between the two conductors, the cable may be safely operated at action (integral of current squared multiplied by time) rating of three or more times that of a cable using conventional insulator material. Magnetic pressure within the cable, due to interaction between current and the produced magnetic fields, produces pressure in excess of 100 PSI between the conductors. It is therefore necessary to reinforce the insulating jacket with high strength fiber containment to withstand these forces. KEVLAR fiber has been selected for this design due to its high strength and high operating temperature capability. The combination of large, matched conductor cross-section, high temperature insulation and high strength containment allows this cable to replace more than six of the best available conventional cables.

Advantages of the Invention Over Prior Art

1. This coaxial cable is specifically designed for carrying millisecond current peaks as high as 150 kiloamps. This is accomplished by use of large cross-section conductors whose strands are nickel plated to permit high temperature operation without oxidation, and by matching center conductor and outer conductor areas to allow for equal current capacity without excessive heating of one conductor.

2. This coaxial cable has matching large area conductor cross-sections made up of strands of wire formed into twisted bundles, with bundles wrapped in opposing directions for flexibility and for minimizing electromagnetic fields outside of the cable.

3. This coaxial cable, having approximately equal inner and outer conductor cross-sections, is designed to withstand electromagnetic forces produced by current as high as 200 kA, by utilizing a high strength woven cover to reinforce and provide strength to the insulating material in which the conductors are encased.

4. This coaxial cable is specifically designed for high temperature operation while maintaining high voltage capabilities, by providing insulation between conductors capable of reliable operation to temperature as high as 260° C.

Utility

This cable may be used in any pulsed power system requiring high electrical energy transfer. It is particularly suitable for reducing quantity and simplifying interface requirements where intense, short (millisecond ) duration electrical pulses are desired or where external magnetic fields are undesirable. Specific examples include interfacing between a variety of power supplies and electromagnetic mass accelerators (electric guns), interfacing between high voltage capacitor banks and electro-thermal or electro-thermal chemical guns, use between remote power sources and electromagnetic aircraft launcher (being developed by Navy) and use in power conditioning systems for nuclear weapons simulators and high energy laser systems.

BRIEF DESCRIPTION OF THE DRAWING

FIG. 1 is a diagram showing a cable according the

DETAILED DESCRIPTION

The invention is disclosed in a paper titled "High Energy Cable Development for Pulsed Power Applications" by Jamison et al in the IEEE Transactions of Magnetics, Vol. 27, No. 1, January 1991, based on an oral presentation at the 5th Symposium on Electromagnetic Launcher Technology, San Destin, Fla., April 1990. The IEEE paper is hereby incorporated by reference.

Figure 1:
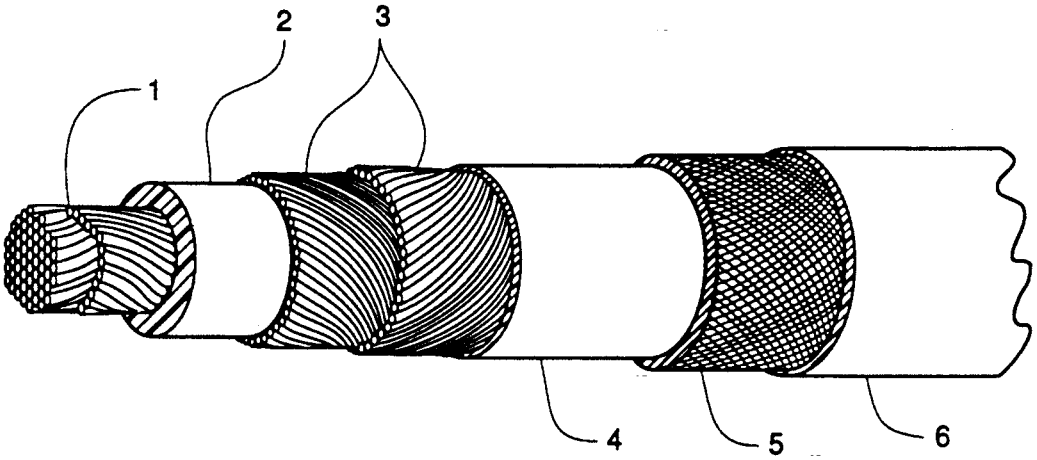
Figure 2:
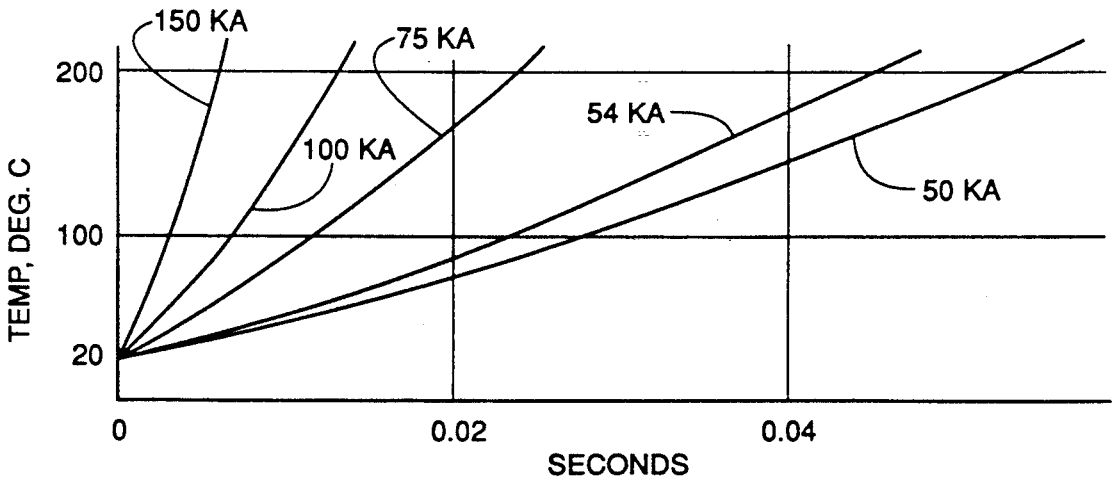
FIG. 2 is a set of curves defining design current parameters.

The cut away view of the cable configuration fabricated and tested for this invention is shown in FIG. 1, and a set of curves defining design current parameters is shown in FIG. 2. The seven elements which comprise the cable are discussed below.

Center Conductor: The center conductor 1 is approximately 2/0 AWG stranded copper wire. It is actually comprised of 1330 30 gauge nickel plated copper strands. In its present configuration it has a nominal diameter of 12.2 mm (0.480 in). The core portion of the strands are counter wound from the outer strands for improved flexibility. The total cross-sectional area is 68 $mm^2$ (or a current carrying cross-section of 130,000 circular mil area).

Inner Dielectric: The inner dielectric 2 is extruded perfluoroalkoxy, (PFA) TEFLON with a nominal wall thickness of 5.1 mm. The nominal outside diameter is 22.2 mm (0.875 in). The TEFLON should permit operational temperatures of the conductors to slightly exceed 260° C. without producing irreversable damage.

Outer Conductor: The outer conductor 3 is comprised of two counter wound layers of stranded nickel plated copper wire. Each layer is formed from 48 stranded wires which have been made from nineteen 30-gauge strands. The total cross-sectional area is 93 $mm^2$ (155,000 circular mils).

Outer Dielectric: The outer dielectric 4, made of extruded PFA TEFLON, is utilized to hold the outer conductor in place since it is not braided. The other dielectric also allows conductor heating to 260 degrees C without irreversable damage. It has a nominal wall thickness of 1.6 mm and a nominal outside diameter is 31 mm (1.220 in).

Kevlar Braid: A reinforcing mesh 5 is woven over the outer dielectric to aid in the containment of the magnetic burst forces. The mesh is manufactured from the aramid fiber KEVLAR, and is shown approximately to scale in FIG. 1. Braid angles were kept high to maximize strength in the radial direction and maintain tightness during manufacture.

Outer Jacket: The outer jacket 6 is made of a flame retardent polyether based polyurethane. The primary need for the outer jacket is for protection of the cable during handling but it also serves to provide added electrical insulation if the outer conductor is to be operated at a high voltage potential. This provides a flame and scuff-resisting poly-vinyl chloride cover.

The cable weight is approximately 2.5 kg/m (1.7 lb/ft). The overall assembly is less than 35 mm in diameter. The operating voltage should be in excess of 15 kV (rms).

At each end, a connector is required for inter-connecting the cable to other equipment. This necessitates removal of the insulating material and concurrently the magnetic force containment. As a result, a connector in needed which provides both good electrical contact and mechanical support against magnetic forces. Cable terminations which provide these functions are covered by a related patent application.

Scope of the Invention

A broad range of conductor sizes, insulator materials and thicknesses, and force containment materials are possible within the scope of this invention. Additionally, wire strand or bundle insulation could be used with conductor interweaving, to improve high frequency performance. Specific points of importance are as follows:

It is desired that the conductor be flexible, have maximum cross-section area consistent with a weight which allows it to be installed or removed by individuals, and be designed so that its maximum electromagnetic force can be self contained by the insulator. One such design now in operation utilizes a conventional "00" gauge conductor 1 made of strands of "30" gauge wires twisted into bundles, typically 19 strands per bundle. Total cross-section area of the conductor is approximately 130,000 circular mils. Wire bundles are twisted into a rope configuration with inner and outer groups of bundles twisted in opposing directions to improve flexibility. Each 30 gauge wire strand is nickel plated to avoid conductor oxidation due to both high temperature fabrication processes and to high temperature operation.

The outer coaxial conductor 3 also uses 19 strand bundles of 30 gauge wire. These bundles are wrapped in two layers, with layers having an opposing twist, to minimize magnetic field leakage and to provide improved flexibility. When conductors carry currents in the same direction, as in the case of the outer conductor layers, they are pulled toward each other by electromagnetic forces. At the current levels for which this cable is designed, these "pinch" forces are sufficient to damage the conductors, if they are allowed to flex significantly. Thus, although it is desired that the outer coaxial conductor have an area identical to the inner conductor, it is actually slightly larger (155,000 circular mils as opposed to 130,000 circular mils) in order to completely fill the conductor region and prevent voids which would allow pinching force damage.

The insulating material selected for this design is a PFE TEFLON which is extruded onto the conductor at a temperature of approximately 600° C. A thickness of 0.200 inches was selected to allow sufficient insulation 2 between conductors to withstand greater than 50,000 volt electrical field stress. A thinner layer 4 of the same insulator (0.060 in.) is used as a thermal barrier between the outer conductor and the polyvinyl chloride protective cover 6.

Mechanical strength is provided by a KEVLAR fiber cover 5 woven over the outer TEFLON insulator 4, and protected by the PVC jacket 6. This assembly can withstand pressure of more than 100 PSI, without damage. Such pressures exist at current amplitude in the order of 150–200 kiloamperes. The cable configuration described has been tested to peak current in excess of 200 kiloamperes without damage.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. A high energy coaxial cable for use in pulsed high energy systems, comprising:

a center conductor comprising bundles of nickel plated fine copper wire, with bundles counter-wound in layers;

an outer conductor comprised of two counter-wound layers of stranded nickel plated fine copper wire, the cross-sectional area of the outer conductor being approximately equal to that of the inner conductor;

an inner dielectric between the center and outer conductors, the dielectric being of insulating materials capable of reliable operation to 260° C.;

an outer dielectric over the outer conductor for holding the outer conductor in place, the dielectric being of insulating materials capable of reliable operation to 260° C.;

a reinforcing mesh woven as a braid over the outer dielectric for aiding in the containment of magnetic burst forces, the mesh being manufactured from a high strength reinforcing material, with braid angles kept high for maximizing strength in the radial direction and maintaining tightness during manufacture; and an outer jacket made of insulating material.

2. A high energy coaxial cable for use in pulsed high energy systems, comprising:

a center conductor comprised of fine nickel plated copper strands, wherein a core portion of the strands are counter-wound from the outer strands for improved flexibility;

an outer conductor comprised of two counter-wound layers of stranded nickel plated fine copper wire, the cross-sectional area of the outer conductor being slightly greater than that of the inner conductor in order to completely fill the conductor region and prevent voids which would allow pinching force damage;

an inner dielectric between the center and outer conductors, the dielectric being of extruded perfluoroalkoxy (PFA);

an outer dielectric over the outer conductor for holding the outer conductor in place, the dielectric being extruded perfluoroalkoxy (PFA), whereby the operational temperatures of the conductors may exceed 260° C.;

a reinforcing mesh woven as a braid over the outer dielectric for aiding in the containment of magnetic burst forces, the mesh being manufactured from an aramid fiber, with braid angles kept high for maximizing strength in the radial direction and maintaining tightness during manufacture;

an outer jacket made of a flame retardent polyether based polyurethane.

3. A high energy coaxial cable for use in pulsed high energy systems, comprising:

a center conductor comprised of 1330 30-gauge nickel plated copper strands, wherein a core portion of the strands are counter wound from the outer strands for improved flexibility, with a total cross-sectional area of 68 $mm^2$;

an outer conductor comprised of two counter-wound layers of stranded nickel plated copper wire, each layer being formed from 48 stranded wires which have been made from nineteen 30-gauge strands, with a total cross-sectional area of 93 $mm^2$;

an inner dielectric between the center and outer conductors, the dielectric being of extruded perfluoroalkoxy (PFA) with a nominal wall thickness of 5.1 mm and a nominal outside diameter of 22.2 mm, whereby the operational temperatures of the conductors may slightly exceed 260° C.;

an outer dielectric over the outer conductor for holding the outer conductor in place, the dielectric being extruded perfluoroalkoxy (PFA), with a nominal wall thickness of 1.6 mm and a nominal outside diameter of 31 mm;

a reinforcing mesh woven as a braid over the outer dielectric for aiding in the containment of magnetic burst forces, the mesh being manufactured from an aramid fiber, with braid angles kept high for maximizing strength in the radial direction and maintaining tightness during manufacture;

an outer jacket made of a flame retardent polyether based polyurethane.

* * * * *